United States Patent [19]

Salentine

[11] Patent Number: 4,575,431

[45] Date of Patent: Mar. 11, 1986

[54] LUBRICANT COMPOSITION CONTAINING A MIXTURE OF NEUTRALIZED PHOSPHATES

[75] Inventor: Christopher G. Salentine, Mill Valley, Calif.

[73] Assignee: Chevron Research Company, San Francisco, Calif.

[21] Appl. No.: 761,210

[22] Filed: Jul. 31, 1985

Related U.S. Application Data

[63] Continuation-in-part of Ser. No. 615,508, May 30, 1984, abandoned.

[51] Int. Cl.[4] ..... C10M 137/10; C10M 137/04

[52] U.S. Cl. ..... 252/32.7 E; 252/46.6; 252/46.7; 252/49.9

[58] Field of Search ..... 252/32.5, 32.7 E, 46.6, 252/46.7, 49.9

[56] References Cited

U.S. PATENT DOCUMENTS

| | | | |
|---|---|---|---|
| 2,346,155 | 4/1944 | Denison | 252/32.5 |
| 2,916,449 | 12/1959 | Vierk et al. | 252/32.7 E |
| 3,997,454 | 12/1976 | Adams | 252/32.7 E |
| 4,431,552 | 2/1984 | Salentine | 252/32.7 E |

OTHER PUBLICATIONS

Zuidema, The Performance of Lubricating Oils; 1959, pp. 12–13.

*Primary Examiner*—Jacqueline V. Howard
*Attorney, Agent, or Firm*—S. R. LaPaglia; R. C. Gaffney; J. J. DeYoung

[57] ABSTRACT

Disclosed is a lubricating oil additive comprising a mixture of phosphates, said phosphates being essentially free of monothiophosphates and comprising:

(a) dihydrocarbyl hydrogen dithiophosphates; and (b) a sulfur-free mixture of hydrocarbyl dihydrogen phosphates and dihydrocarbyl hydrogen phosphates, said composition being at least 50% neutralized by a hydrocarbyl amine having 10 to 30 carbons in said hydrocarbyl group.

18 Claims, No Drawings

LUBRICANT COMPOSITION CONTAINING A MIXTURE OF NEUTRALIZED PHOSPHATES

CROSS REFERENCE TO RELATED APPLICATIONS

This application is a continuation-in-part of Ser. No. 615,508, filed May 30, 1984, now abandoned, the entire disclosure of which is incorporated herein by reference.

BACKGROUND OF THE INVENTION

The invention relates to extreme pressure additives for lubricating oils. More particularly, the invention relates to the finding that the extreme pressure properties of a lubricant are greatly improved by the addition of a specific mixture of phosphates, said phosphates comprising: (a) substituted dithiophosphates and (b) mono and disubstituted sulfur-free phosphates wherein the composition has been neutralized by reaction with a hydrocarbyl amine.

Lubricants containing dithiophosphates per se, monothiophosphates per se and mono and disubstituted phosphates per se are well known in the art. For example, U.S. Pat. No. 4,431,552, which discloses a borate-containing lubricant composition also containing a mixture of phosphates, monothiophosphates and dithiophosphates in a critical ratio. In the present invention it has been found that monothiophosphates adversely effect the extreme pressure properties of the lubricant.

It is an object of the present invention to provide a lubricant having improved extreme pressure properties. The improved properties are obtained through the combination of specific phosphates which have been neutralized by a hydrocarbyl amine.

SUMMARY OF THE INVENTION

A lubricating oil additive composition comprising a mixture of phosphates, said phosphates being essentially free of monothiophosphates and comprising: (a) dihydrocarbyl hydrogen dithiophosphates; and (b) a sulfur-free mixture of hydrocarbyl dihydrogen phosphates and dihydrocarbyl hydrogen phosphates said composition being at least 50% neutralized by a hydrocarbyl amine having 10 to 30 carbons in said hydrocarbyl group.

DETAILED DESCRIPTION OF THE INVENTION

The lubricant composition comprises an oil of lubricating viscosity having dispersed therein a mixture of phosphates, said phosphates being essentially free of monothiophosphates and comprising: (a) dihydrocarbyl hydrogen dithiophosphates; and (b) a sulfur-free mixture oif hydrocarbyl dihydrogen phosphates and dihydrocarbyl hydrogen phosphates said composition being at least 50% neutralized by a hydrocarbyl amine having 10 to 30 carbons in said hydrocarbyl group.

As used in the present application the term "essentially free of monothiophosphates" means that the lubricant or lubricant additive does not contain any monothiophosphates that are materially detrimental to the extreme pressure properties of the lubricant. Preferably the lubricant or lubricant additive of the present invention contains no monothiophosphates whatsoever.

Each of the individual components of the lubricant and additive composition of this invention are well known in the art.

The Dithiophosphates

Typical dithiophosphates useful in the lubricant of the present invention are well known in the art. These dithiophosphates are those containing two hydrocarbyl groups and one hydrogen functionality, and are therefore acidic. The hydrocarbyl groups useful herein are preferably aliphatic alkyl groups of 3 to 8 carbon atoms.

Representative dihydrocarbyl dithiophosphates include di-2-ethyl-1-hexyl hydrogen dithiophosphate, diisoctyl hydrogen dithiophosphaste, dipropyl hydrogen dithiophosphate and di-4-methyl-2-pentyl hydrogen dithiophosphate.

Preferred dithiophosphates are dihexyl hydrogen dithiophosphate, dibutyl hydrogen dithiophosphate, and di-n-hexyl hydrogen dithiophosphate.

The Sulfur-free Phosphates

Typical non-sulfur-containing phosphates useful in the present invention are well known in the art and include the dihydrocarbyl hydrogen phosphates and the monohydrocarbyl dihydrogen phosphates where the hydrocarbyl will contain 1 to 10, and preferably 3 to 5 carbon atoms, and most preferably 4 carbon atoms. The hydrocarbyl is an aliphatic alkyl group. Representative phosphates include:

methyl dihydrogen phosphate, propyl dihydrogen phosphate, butyl dihydrogen phosphate, dibutyl hydrogen phosphate; dipentyl hydrogen phosphate; pentyl dihydrogen phosphate; hexyl dihydrogen phosphate, decyl dihydrogen phosphate, and the like.

Preferred is a mixture of dibutyl hydrogen phosphate, and butyl dihydrogen phosphate.

The Amines

For use in the present invention the mixture of acidic phosphates is partially or completely neutralized by reaction with alkylamines. The resulting composition is a complex mixture of alkylammonium salts, mixed acid-alkylammonium salts and acids of the sulfur-free mono and dihydrocarbyl phosphates and alkylammonium salts and free acids of the dihydrocarbyl dithiophosphates. Neutralization must be at least 50%, preferably at least 80% complete. For best results, neutralization should be in the range of 85% to 95%, wherein 100% neutralization refers to the reaction of one alkylamine with each acid hydrogen atom.

The amine alkyl group is from 10 to 30 preferably 12 to 18 carbons in length. Typical amines include pentadecylamine, octadecylamine, cetylamine, and the like. Most preferred is oleylamine. The mole ratio of the dithiophosphates to the sulfur-free phosphates should be in the range of 70:30 to 30:70, preferably 55:45 to 45:55 and most preferably 1:1. The mole ratio of the substituted dihydrogen phosphates to the disubstituted hydrogen phosphates should be in the range 30:70 to 55:45, preferably 35:65 to 50:50 and most preferably 45:55.

The compositions of the present invention are particularly useful for their antiwear properties, antirust properties, and are useful in improving the water tolerance properties and seal leak properties of lubricants containing alkali metal borates. The preferred utility for the compositions of the present invention is as an extreme pressure (EP) additive.

The lubricant composition contains an effective amount of the mixed neutralized phosphates to improve the extreme pressure properties of the lubricant. Generally, the lubricant will contain 0.01 to 5.0 weight percent of the phosphate mixture and preferably 0.1 to 2.0 weight percent.

The lubricating oil to which the neutralized phosphates are added, can be any hydrocarbon-based lubricating oil or a synthetic base oil stock. The hydrocarbon lubricating oils may be derived from synthetic or natural sources and may be paraffinic, naphthenic or asphaltic base, or mixtures thereof. A variety of other additives can be present in lubricating oils of the present invention. These additives include antioxidants, viscosity index improvers dispersants, rust inhibitors, foam inhibitors, corrosion inhibitors, other antiwear agents, and a variety of other well-known additives. Preferred additional additives are the oil-soluble succinimides and oil-soluble alkali or alkaline earth metal sulfonates. Particularly preferred additional additives include sulfurized olefins and the alkali metal borates, particularly from about 0.1 to 10.0 weight percent of each, and more preferably 1.0 to 6.0 weight percent of a potassium triborate as taught in U.S. Pat. No. 3,997,454.

EXAMPLES 1–4

A series of tests were performed on various test sample compositions to measure the extreme pressure properties of the lubricant using the Timken EP test. The Timken test is a well-known standardized test and is described in ASTM-D 2782, which test procedure is incorporated herein by reference. In these examples, the base oil is Exxon SAE 80W-90 containing no other additives than those listed in Table I, below. The dithiophosphate compounds have 6-carbon alkyl groups and the sulfur-free phosphates have 4-carbon alkyl group. All of the phosphates have been essentially neutralized with $C_{18}$ primary amines.

The test results are shown below in Table I.

TABLE I

| Ex. | Total Phosphate Conc. | Sulfur-free Phosphate Conc. | Monothio Phosphate Conc. | Dithio Phosphate Conc. | Timken OK Load, Lbs. |
|---|---|---|---|---|---|
| 1 | 0 | 0 | 0 | 0 | 5 |
| 2 | 1.0 | 0.5 | 0 | 0.5 | 60 |
| 3 | 1.0 | 1.0 | 0 | 0 | 10 |
| 4 | 1.0 | 0 | 0 | 1.0 | 15 |

Comparison of examples 1 with 2 shows that the addition of the composition of this invention provides a dramatic and surprising improvement in the Timken EP performance.

Comparison of examples 1 with 3 and 4 shows that at the same total phosphate concentration neither the sulfur free phosphate alone nor the dithiophosphate alone were effective in improving the extreme pressure performance of the base oil.

EXAMPLES 5–11

Additional Timken tests were performed on various test sample compositions. In these examples, the base oil is Exxon SAE 80W-90 containing 3.0 weight percent of a potassium triborate dispersion (comprising 45 percent diluent oil) and a sulfurized hydrocarbon providing the amount of sulfur shown in Table II. The monothio and dithiophosphate compounds have 6-carbon alkyl groups and the sulfur-free phosphates have 4-carbon alkyl groups except Examples 10 and 11 have 6-carbon alkyl groups on the sulfur-free phosphates and Example 8 which has 8 to 10-carbon alkyl groups. All of the phosphates have been essentially neutralized with $C_{12}$ to $C_{18}$ primary amines.

The test results are shown below in Table II.

TABLE II

| Ex. | Total Phosphate Conc. | Sulfur-free Phosphate Conc. | Monothio Phosphate Conc. | Dithio Phosphate Conc. | Weight Percent Sulfur | Timken OK Load, Lbs. |
|---|---|---|---|---|---|---|
| 5 | 0 | 0 | 0 | 0 | 0.92 | 50 |
| 6 | 0.60 | 0.30 | 0 | .30 | 0.92 | 70 |
| 7 | 0.30 | 0.15 | 0 | .15 | 0.92 | 70 |
| 8 | 0.30 | 0.30 | 0 | 0 | 0.92 | 50 |
| 9 | 0.30 | 0 | 0 | 0.30 | 0.78 | 45 |
| 10 | 1.0 | 0.40 | 0.19 | 0.41 | 0.88 | 60 |
| 11 | 0.65 | 0.26 | 0.13 | 0.26 | 0.64 | 45 |

Comparison of Examples 5 with 6 and 7 shows that the composition of the present invention provides greatly improved EP properties as shown by the Timken test.

Comparison of Examples 5 and 7 with Examples 8 and 9 shows that both sulfur-free phosphates and dithiophosphates are necessary to obtain improved EP properties in the Timken test. Example 7 contains a total of 0.30 weight percent of an equal mixture of sulfur-free phosphates and dithiophosphates and it had excellent EP properties. Example 8 contains sulfur-free phosphates only and none of the dithiophosphates and the results were no better than the base case as shown in Example 5. Example 9 contains the dithiophosphates alone and its Timken EP values were slightly less than the base case alone.

Comparison of Examples 7 and 10 and 11 indicates that the presence of monothiophosphates is detrimental to the composition of the present invention in the Timken test, even at high concentrations.

What is claimed is:

1. A lubricating oil additive comprising a mixture of phosphates, said phosphates being essentially free of monothiophosphates and comprising:

(a) dihydrocarbyl hydrogen dithiophosphates; and (b) a sulfur-free mixture of hydrocarbyl dihydrogen phosphates and dihydrocarbyl hydrogen phosphates, said composition being at least 50% neutralized by a hydrocarbyl amine having 10 to 30 carbons in said hydrocarbyl group.

2. The composition of claim 1 wherein the hydrocarbyl groups in said dihydrocarbyl hydrogen dithiophosphate, hydrocarbyl dihydrogen phosphates, and dihydrocarbyl hydrogen phosphates are alkyl groups of 1 to 10 carbon atoms.

3. The composition of claim 2 wherein the hydrocarbyl group in said dihydrocarbyl hydrogen dithiophosphate is an alkyl group containing 3 to 8 carbon atoms.

4. The composition of claim 3 wherein the hydrocarbyl group in said hydrocarbyl dihydrogen phosphates and dihydrocarbyl hydrogen phosphates is an alkyl group with 1 to 4 carbon atoms.

5. The composition of claim 4 wherein the mole ratio of the hydrocarbyl dihydrogen phosphates to dihydrocarbyl hydrogen phosphates is 35:65 to 50:50.

6. The composition of claim 5 wherein the mole ratio of the dihydrocarbyl hydrogen dithiophosphates to the sulfur-free phosphates is 55:45 to 45:55.

7. The composition of claim 6 wherein the hydrocarbyl amine is a monoalkyl amine having 12 to 18 carbon atoms in the alkyl group.

8. The composition of claim 7 wherein the alkylamine is oleylamine and said composition is at least 80% neutralized.

9. The composition of claim 8 wherein said additive contains alkali metal borate.

10. The additive composition of claim 9 wherein said composition also contains a sulfurized hydrocarbon.

11. A lubricating oil additive composition comprising a mixture of phosphates, said phosphates consisting essentially of:

(a) di-n-hexyl hydrogen dithiophosphate, and (b) a mixture of butyl dihydrogen phosphate and dibutyl hydrogen phosphate, said composition being at least 80% neutralized by oleylamine.

12. The composition of claim 11 wherein the mole ratio of (a) to (b) is 1:1 and the mole ratio of butyl dihydrogen phosphate to dibutyl hydrogen phosphate is 45:55.

13. The composition of claim 12 wherein the composition also contains an alkali metal borate and a sulfurized hydrocarbon.

14. A lubricating oil additive consisting essentially of a mixture of phosphates, said phosphates being essentially free of monothiophosphates and consisting essentially of:

(a) dihydrocarbyl hydrogen dithiophosphates; and (b) a sulfur-free mixture of hydrocarbyl dihydrogen phosphates and dihydrocarbyl hydrogen phosphates, said composition being at least 80% neutralized by a hydrocarbyl amine having 12 to 18 carbons in said hydrocarbyl group, wherein the mole ratio of (a) to (b) is 55:45 to 45:55.

15. A lubricating composition comprising a major amount of lubricating oil and a minor but effective amount of the additive of claim 1 to improve the extreme pressure properties of the lubricating composition.

16. The composition of claim 15 wherein the composition contains 0.1 to 5.0 weight percent of said additive.

17. The composition of claim 16 wherein the composition also contains 1.0 to 6.0 weight percent of a potassium triborate.

18. The composition of claim 15 wherein the composition also contains 0.1 to 10.0 weight percent sulfurized olefins and 0.1 to 10.0 weight percent alkali metal borates.

* * * * *